United States Patent [19]

Pastva

[11] 4,397,488

[45] Aug. 9, 1983

[54] CLOSURE CONTROL MECHANISM

[75] Inventor: John V. Pastva, Parma Heights, Ohio

[73] Assignee: The Eastern Company, Cleveland, Ohio

[21] Appl. No.: 184,310

[22] Filed: Sep. 5, 1980

[51] Int. Cl.[3] ..... E05C 9/08

[52] U.S. Cl. ..... 292/210; 292/218; 292/DIG. 72

[58] Field of Search ..... 292/210, 218, 213, 216, 292/DIG. 32, DIG. 72

[56] References Cited

U.S. PATENT DOCUMENTS

| | | | |
|---|---|---|---|
| 1,592,213 | 7/1926 | Kleckner | 292/DIG. 72 |
| 1,919,328 | 7/1933 | Hansen | 292/DIG. 72 |
| 3,281,177 | 10/1966 | Tenenbaum | 292/202 X |
| 3,370,877 | 2/1968 | Hallberg | 292/DIG. 32 X |

*Primary Examiner*—Richard E. Moore

*Attorney, Agent, or Firm*—Watts, Hoffmann, Fisher & Heinke

[57] ABSTRACT

A closure control mechanism especially designed for a pivoted door of a cargo carrier, such as, a highway or off-highway truck or trailer, cargo container, tanker and the like. The closure mechanism includes a hinged lock shaft adapted to be connected to one or the other of two members one of which is hinged and adapted to be selectively secured in closed position relative to the other, a keeper member(s) having a base part adapted to be secured to the other of the first two mentioned members and a part spaced from the base part having a surface facing in the direction of the base part for engagement with the lock shaft when the lock shaft is pivoted in the direction to move the hinged member of the first two mentioned members away from the other.

2 Claims, 4 Drawing Figures

CLOSURE CONTROL MECHANISM

BACKGROUND OF THE INVENTION

1. Field of the Invention

Swinging bolt type closure control mechanism.

2. Description of the Prior Art

This invention relates to a closure control mechanism of the cam-bolt latch and keeper type for use with a pivoted door, especially a door of a cargo carrier, such as, a truck, truck trailer, cargo container, tanker or the like.

Many highway trucks, truck trailers, cargo containers, tankers and like vehicles, and also non-highway vehicles, typically have a pivoted door(s) through which loading and unloading of the vehicle or container is accomplished. Gasket seals are employed with the door(s) of air-conditioned and refrigerator trucks and other trucks where a dust-free capability is desired etc. Cam-bolt type closure control mechanisms, commonly referred to as locks, used with pivoted doors of trucks and like vehicles typically comprise a latch or bolt member(s) pivotally connected to the door or a member to which the door is to be selectively secured closed adjacent to the non-pivoted edge of the door. The bolt member(s) engage with a keeper member(s) on another door or member to which the door is to be secured closed to retain the door in closed position. The latch and keeper members secure the door in closed position at spaced points and are typically referred to as "two point" locks, "three point" locks, etc., depending upon the number of points at which they secure the door in closed position.

In some instances locks of the character referred to do not have a so-called frost-breaking or door releasing action or capability when the bolt is rotated or pivoted in the direction to open the locks and/or the lock does not act against the full length of the door.

SUMMARY OF THE INVENTION

The present invention provides a novel and improved cam-bolt type closure control mechanism or lock especially designed for use with pivoted doors of a cargo-type carrier, such as, cargo container, highway vehicle and the like which lock is rugged in construction, is reliable in operation, is applicable to various size doors, has a frost-breaking and door releasing action and/or acts upon the full length of the door.

Further advantages and improved features of the closure control mechanism of the present invention will be hereinafter referred to or will be apparent from the drawings and description of the preferred embodiment of the invention.

DESCRIPTION OF THE PREFERRED EMBODIMENT

Figure 1:
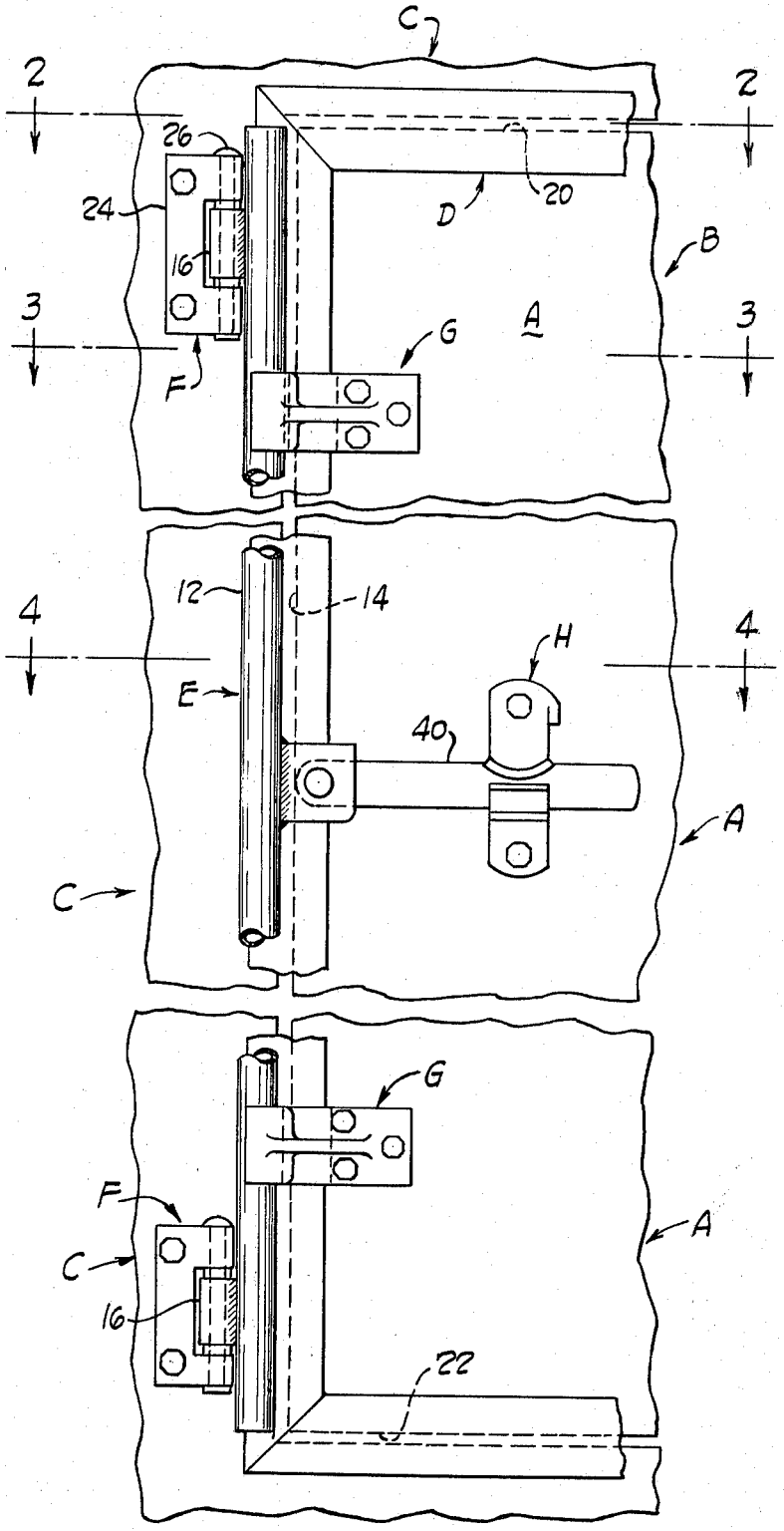
FIG. 1 is a fragmentary elevational view, with parts broken away, of a highway truck-type trailer showing a preferred embodiment of the closure control mechanism of the invention applied to a side access door of the trailer.

The preferred embodiment of the closure control mechanism of the present invention, illustrated in the drawings, is used to secure the side access door A of a truck-type cargo trailer B in closed position. The right-hand edge of the door A, as viewed in FIG. 1, is pivotally connected to the body C of the trailer B in a conventional manner. The reference character D designates a seal gasket carried by the door A. The door A is selectably securable in closed position by a lock mechanism designated generally by the reference characters E.

The lock or door control mechanism E includes a cylindrical tubular operating shaft 12 pivotally connected to the body C of the trailer B adjacent to the free or non-pivoted edge 14 of the door A by one or more hinge members F one movable part 16 of each which are welded to the lock rod or shaft 12 adjacent to opposite ends thereof which ends may terminate at the upper and lower edges 20, 22 of the door. The shaft 12 and the hinge part(s) 16 form the bolt part or member of the present lock. The other parts 24 of the hinge members F are fixed to the body C in a suitable manner as by bolts, welding etc. The two parts 16, 24 of each of the hinge members F are pivoted together by pintle pins 26 and their pivotal axes are offset to one side of the shaft 12. The latch or lock shaft 12 cooperate with upper and lower keeper members G secured to the door A adjacent to the non-pivoted edge 14 thereof. Each of the keeper members G has a base part 30 secured to the door A and a part 34 overlying a portion 36 of the base part 30 providing a surface 38, preferably slightly concave, facing the portion 36 and the door A.

A handle assembly 40 connected to the lock shaft 12 is provided for pivoting the shaft 12 about the axis of the pintle pins 26 of the hinge members F which pintle pins are aligned with one another and which axis is offset from the shaft 12. A handle retainer assembly H of conventional construction attached to the door A is provided for securing the handle in a fixed position relative to the door.

Figure 2:
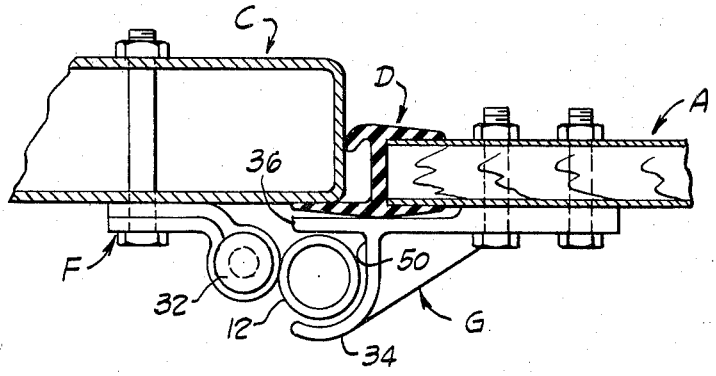
FIG. 2 is an enlarged fragmentary sectional view approximately on the line 2—2 of FIG. 1.
Figure 3:
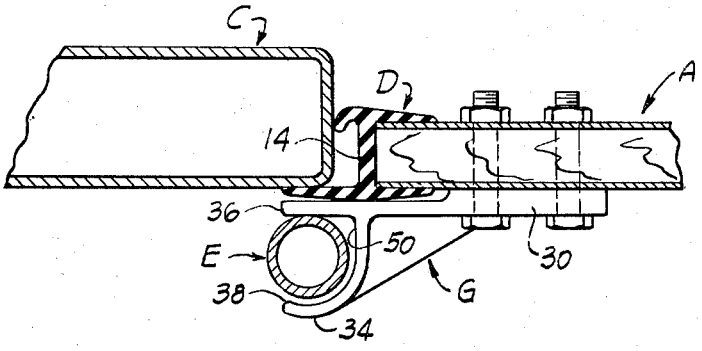
FIG. 3 is an enlarged fragmentary sectional view approximately on the line 3—3 of FIG. 1.
Figure 4:
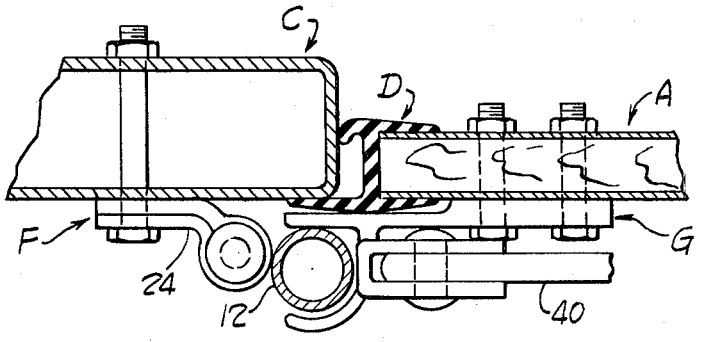
FIG. 4 is an enlarged fragmentary sectional view approximately on the line 4—4 of FIG. 1.

When the door A is in closed position the lock rod or shaft 12 lies in the apertures 50 in the keepers G between the portions 36 and the parts 34 thereof. The apertures 50 faces outwardly of the door A in the direction away from its hinged edge. When the lock shaft 12 is rotated or pivoted about the axis of the pintle pins 26 in a counter clockwise direction as viewed in FIGS. 2, 3 and 4, it applies a force against the portions 36 of the keepers G and in turn the door A in the direction to close the door. When the lock shaft or rod 12 is rotated or pivoted in the opposite or clockwise direction a force is applied thereby to the parts 34 of the keepers G in the direction to open the door thus incorporating in the lock a so-called "frost-breaking" action and capability.

If, in the depicted embodiment of the invention, the tine-like portions 36 of the base parts 30 of the keepers G are omitted the lock shaft 12 can be made to bear directly against the door A by moving the lock E to the right, as viewed in the drawings, along the door A and trailer body C until the shaft 12 overlies the free edge of the door.

Two discrete keepers G are shown in the drawings but it is to be understood that any desired number of such keepers G may be employed or alternatively that a single keeper extending from adjacent to the top to adjacent to the bottom of the door and having essentially the same cross-sectional shape of the keepers G may be employed.

From the foregoing description of the preferred embodiment of the invention, it will be apparent that the objects heretofore enumerated and other have been accomplished and that a novel and improved lock of the type to which the invention pertains has been provided which is capable of securing a door in proper closed position by applying closing pressure throughout the entire length of the non-pivoted edge of the door and/or incorporates a frost-breaking capability when it is desired to open the door.

While the preferred embodiment of the invention has been shown and described in considerable detail, it will be understood that the invention may be otherwise embodied and it is the intention to hereby cover all adaptions, modifications and uses of the lock disclosed which comes within the practice of those skilled in the art to which the invention pertains and the scope of the appended claims.

What is claimed is:

1. A closure control mechanism for securing a pivoted first member to a second member, said mechanism comprising an elongated bolt member connected to the second member for rotation about an axis spaced from and parallel with the edge of the first member opposite to the pivotal axis of the first member, means for oscillating said bolt member about its axis, and a keeper member attached to the first member adjacent to the edge of the first member opposite to the pivotal axis of the first member, said keeper member having a base part and a part spaced from said base part providing a surface facing in the direction of said base part for engagement of said bolt member therewith when said bolt member is pivoted in one direction about its pivotal connection with said second member.

2. A closure control mechanism for securing a pivoted first member to a second member, said mechanism comprising a single bolt member with an elongated body adapted to be pivotably connected to the second member for rotation about an axis spaced from and parallel with both the body and the edge of the first member opposite to its pivotal axis, means for oscillating said bolt member, and plural keeper member for attachment to the first member adjacent to the edge of the first member opposite to the pivotal axis of the first member and spaced apart in the axial direction of said bolt member, said keeper members each having a base part and an opposed part spaced from said base part providing a surface facing in the direction of said base part and overlying a portion of said base part for alternative engagement of said bolt member therewith and with said base portion overlaid thereby when said bolt member is pivotably secured to the second member and said keeper members(s) to the pivoted first member adjacent to the edge of the first member opposite to its pivotal axis and said bolt member is oscillated in opposite directions about its pivotal connection with said second member.

* * * * *